United States Patent [19]

Williams

[11] Patent Number: 4,724,630

[45] Date of Patent: Feb. 16, 1988

[54] ELECTRIC SIGN

[76] Inventor: Arden Williams, 3993 Plumcrest Cir., Smyrna, Ga. 30080

[21] Appl. No.: 890,933

[22] Filed: Jul. 31, 1986

[51] Int. Cl.[4] ..... G09F 19/04

[52] U.S. Cl. ..... 40/460; 40/359

[58] Field of Search ..... 40/459, 460, 573, 463, 40/902, 464; 340/74; 335/205, 206, 207

[56] References Cited

U.S. PATENT DOCUMENTS

| | | | |
|---|---|---|---|
| 6,722 | 9/1849 | Doughty | 40/460 |
| 24,051 | 5/1859 | Page | 40/460 |
| 1,362,647 | 12/1920 | Stone et al. | 40/460 |
| 1,451,877 | 4/1923 | Koehler et al. | 40/460 |

FOREIGN PATENT DOCUMENTS

| | | | |
|---|---|---|---|
| 453781 | 12/1927 | Fed. Rep. of Germany | 40/459 |
| 693572 | 6/1940 | Fed. Rep. of Germany | 40/463 |
| 2543754 | 4/1977 | Fed. Rep. of Germany | 335/205 |
| 3340419 | 5/1985 | Fed. Rep. of Germany | 335/207 |
| 338302 | 11/1930 | United Kingdom | 40/460 |
| 720147 | 12/1954 | United Kingdom | 40/537 |

*Primary Examiner*—John J. Wilson
*Assistant Examiner*—J. Hakomaki
*Attorney, Agent, or Firm*—Rodgers & Rodgers

[57] ABSTRACT

An electric sign is arranged to afford a readily observable visual indication of the condition of an establishment such as a retail establishment having an entrance door provided with a lock and wherein the sign includes a visual device for indicating a condition of the establishment such as "closed" or "open" together with a switch for energizing the visual device, and a control mechanism actuated in coordination with locking and unlocking of the establishment door for selectively controlling the control mechanism for energizing the visual device.

2 Claims, 3 Drawing Figures

ELECTRIC SIGN

BACKGROUND ART

U.S. Pat. No. 3,688,425 discloses a sign having a number of compartments each adapted to afford a visual indication and which are responsive to control means.

DISCLOSURE OF THE INVENTION

According to this invention in one form, an electric sign for a business or other establishment is provided with several compartments each conveying different information and wherein some of the compartments are energized and deenergized in coordination with locking and unlocking of the establishment door.

BEST MODE OF CARRYING OUT THE INVENTION

Figure 1:
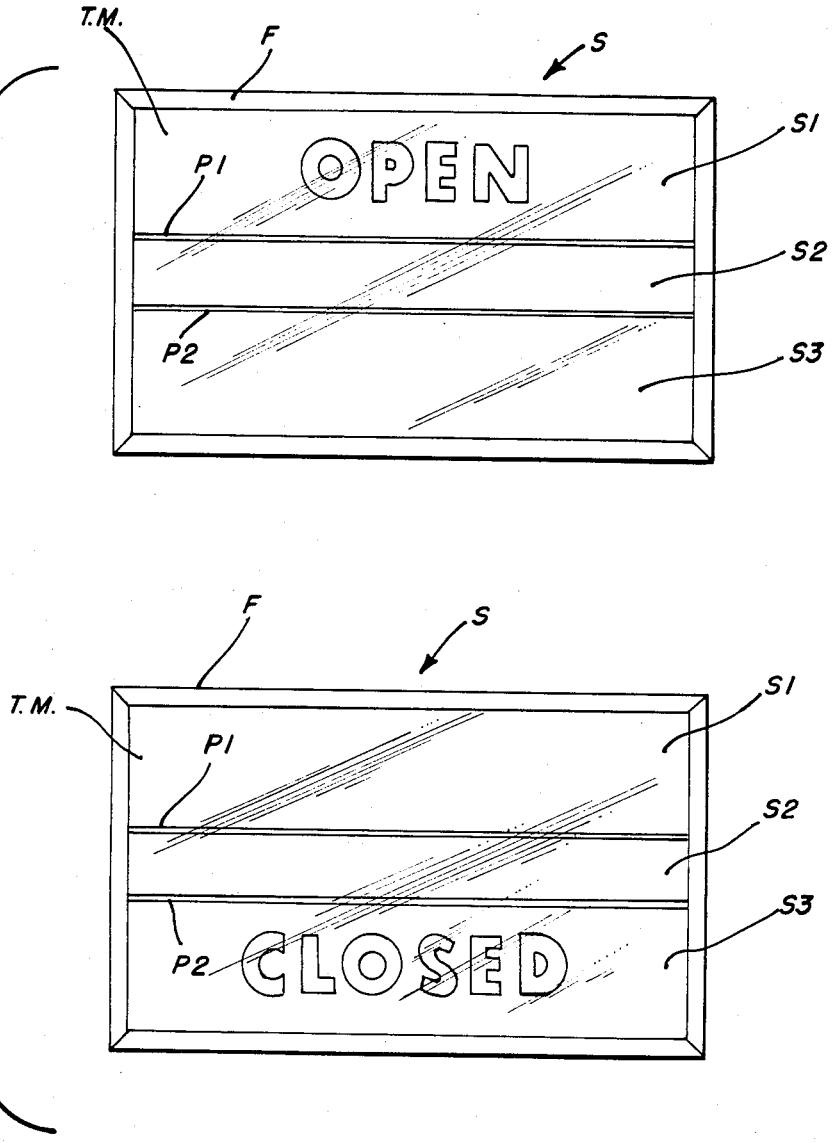
FIG. 1 is a schematic view of a sign formed according to this invention and which indicates by visual means associated with different compartments of the sign the "open" and "closed" condition of the establishment and which may also include other information if desired.
Figure 2:
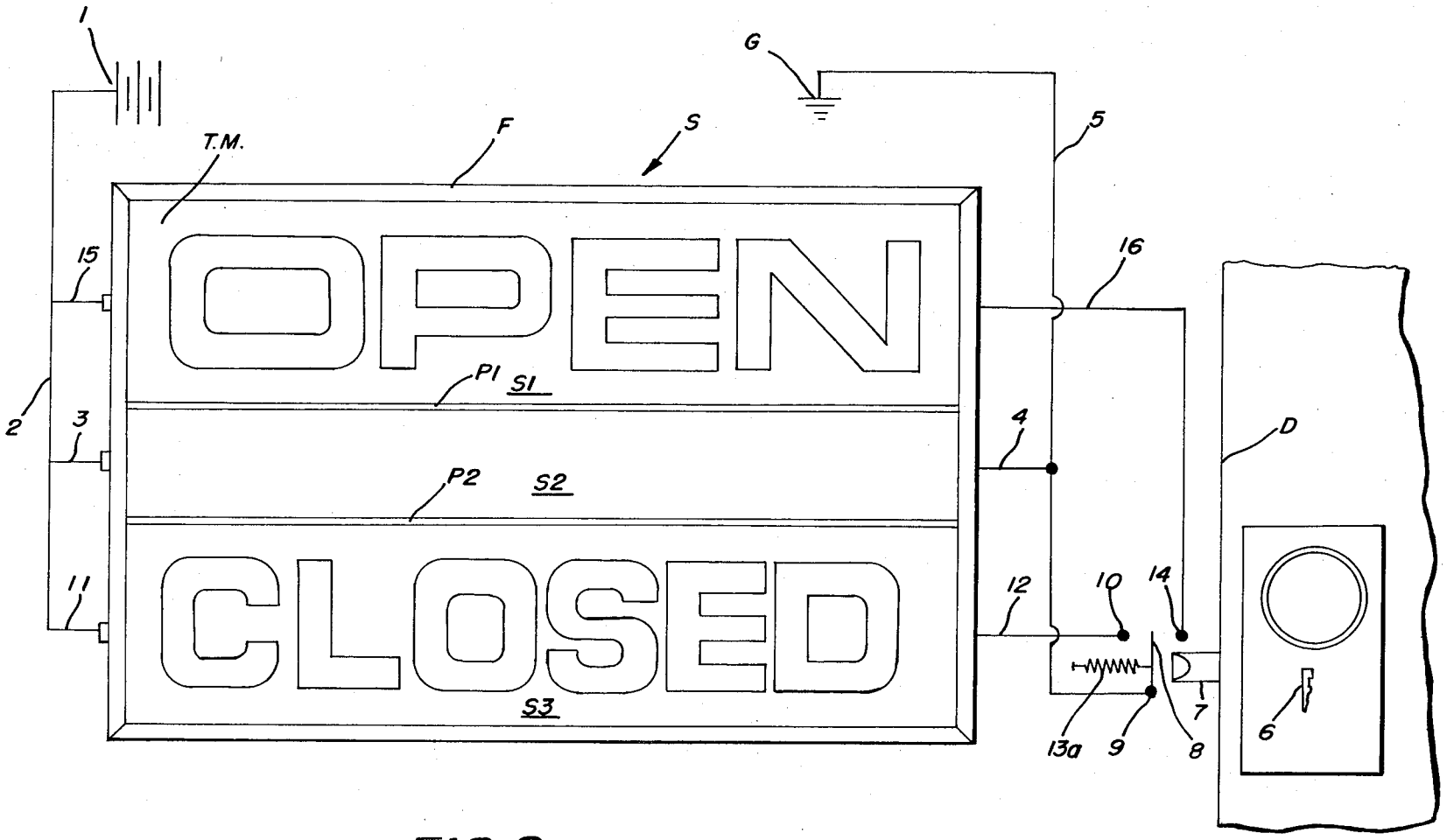
FIG. 2 is a schematic view of the energizing means as well as of the control means associated with the sign.

As is apparent from both FIGS. 1 and 2, a sign formed according to this invention and designated generally by the letter "S" comprises a frame "F" which includes three compartments designated "S1", "S2", and "S3". Compartments "S1" and "S2" are separated by a petition "P1" while compartments "S2" and "S3" are separated by partition "P2". All of the compartments are covered by a front transparent element which could be formed of glass or other translucent material and which is designated at T.M.

The compartments "S1", "S2" and "S3" shown schematically are energized by any suitable means such for example as by flourescent lamps or by a series of incandescent lamp bulbs arranged within each of the three compartments. Sign indicia is of any suitable type such as by different degrees of shading for the background and for the sign data.

The indicia displayed continually by compartment "S2" is due to the fact that its lamps are constantly energized from a source of electric energy indicated by the numeral 1 through lines 2 and 3, 4 and 5 to groud "G". If desired the compartment S2 may be eliminated for certain applications of the invention as is obvious.

In accordance with a feature of this invention, the "open" indication by compartment "S1" and the closed indication by compartment "S3" are controlled in accordance with the lock schematically represented at 6 and having a moveable plunger 7. A contact 8 is pivotally mounted at 9 so that movement toward the left of lock plunger 7 into a locked condition of the door "D" engages contact 8 and causes that contact to swing into engagement with the fixed contact 10 and by so doing to establish a circuit from source 1 through conductors 2 and 11 and the incandescent lamps disposed within compartment "S3", through conductor 12, contacts 10 and 8 and conductor 5 to ground "G" thus to indicate a "closed" condition of the establishment.

When the door is unlocked by appropriate manipulation of lock 6, the plunger 7 is moved toward the right and movable contact 8 under the action of compression spring 13 swings into engagement with fixed contact 14. By this means a circuit is established from the source 1 through lines 2 and 15 and through the lamps disposed within compartment "S1" through line 16, contacts 14 and 8 and conductor 5 to the ground "G" and thus to afford an "open" or unlocked condition of the door "D" and of the establishment.

The hours during which the establishment is open or other suitable information may be displayed by compartment "S2". As is apparent from FIG. 1, compartment "S2" is always energized and is arranged to provide a visual indication of the indicia thereon irrespective of whether the "open" sign of compartment "S1" or the "closed" sign of compartment "S3" is energized.

Figure 3:
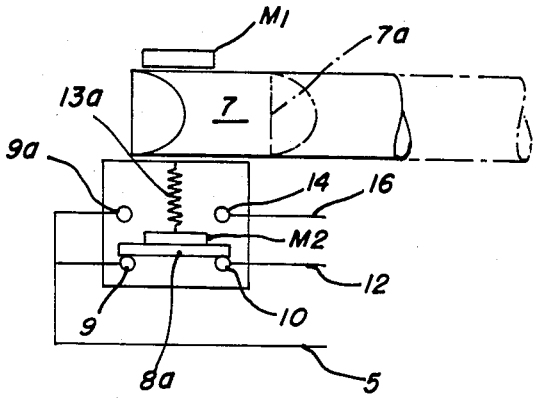
FIG. 3 is an enlarged schematic view of one form of switch for use in certain applications of the invention.

The switch shown in FIG. 3 is magnetically operated and includes a permanent magnet M1 fixed in position adjacent plunger 7 and a permanent magnet M2 mounted on contact 8*a*which is biased toward fixed contacts 9 and 10 by spring 13*a*. As shown plunger 7 isolates the magnets M1 and M2 from each and the circuit is established between terminals 9 and 10 to energize sign S3 to indicate "closed" condition of the establishment and locked condition of plunger 7. When plunger 7 is moved to the right as indicated by dotted lines 7*a* to unlock door D magnet M1 causes magnet M2 and contact 8*a* to move upward against the bias of spring 13*a* to cause contact 8*a* to engage terminals 9*a* and 14 thereby to complete a circuit through condutors 5 and 16 and to energize sign S1 to indicate an "open" condition of the establishment.

INDUSTRIAL APPLICABILITY

This invention is especially well suited for use in conjunction with retail establishments such as barber shops, gift shops and other retail or wholesale outlets as is obvious. The invention is particularly well suited for use in establishments located in large shopping centers where large parking lots are provided and where it may be very inconvenient for a prospective customer to determine whether a certain establishment is open or not if there is no readily observable indicating means.

I claim:

1. An electric sign arranged to afford a readily observable visual indication of a condition of an establishment entrance door provided with a lock having a movable plunger, said sign comprising visual means adapted to indicate a certain condition of the door of the establishment, means for energizing said visual means, control means actuated in coordination with locking and unlocking of the establishment door lock for controlling said means for energizing said visual means, said control means comprising a first pair of fixed contacts, a movable contact biased toward engagement with said first pair of fixed contacts and arranged to engage and to disengage said first pair of fixed contacts thereby to energize and to deenergize a part of said visual means, a first permanent magnet secured to said movable contact, a second permanent magnet spaced from said first permanent magnet, said permanent magnets being disposed on opposite sides of said movable plunger when said plunger is disposed in locked position so that said plunger effectively isolates said permanent magnets from each other and prevents movement of said movable contact out of engagement with said first pair of fixed contacts so as to maintain energization of a part of said visual means thereby to indicate one condition of the establishment door, said second permanent magnet being effective to attract said first permanent magnet so as to move said movable contact out of engagement with said first pair of fixed contacts and to deenergize said part of said visual means when said plunger is moved to its unlocked position and out of its position between said permanent magnets, and a second pair of fixed contacts engageable by said movable contact in response to unlocking movement of said plunger so as to energize another part of said visual means to indicate another condition of the establishment door.

2. An electric sign according to claim 1 wherein said visual means includes an area which is constantly energized.

* * * * *